US005158856A

United States Patent [19]

Usagawa et al.

[11] Patent Number: 5,158,856

[45] Date of Patent: Oct. 27, 1992

[54] SILVER HALIDE PHOTOGRAPHIC LIGHT-SENSITIVE MATERIAL CAPABLE OF PROVIDING A HIGH CONTRAST IMAGE

[75] Inventors: Yasushi Usagawa, Hino; Fumio Ishii, Akishima, both of Japan

[73] Assignee: Konica Corporation, Tokyo, Japan

[21] Appl. No.: 835,070

[22] Filed: Feb. 18, 1992

Related U.S. Application Data

[63] Continuation of Ser. No. 611,431, Nov. 13, 1990, abandoned, which is a continuation of Ser. No. 312,793, Feb. 17, 1989, abandoned.

[30] Foreign Application Priority Data

Feb. 20, 1988 [JP] Japan ..... 63-37718
Dec. 13, 1988 [JP] Japan ..... 63-314542

[51] Int. Cl.[5] ..... G03C 1/34

[52] U.S. Cl. ..... 430/264; 430/267; 430/598; 430/599; 430/600; 430/605

[58] Field of Search ..... 430/264, 267, 598, 599, 430/600, 605

[56] References Cited

U.S. PATENT DOCUMENTS 3,212,900 10/1965 Oguchi et al. ..... 430/531
4,686,167 8/1987 Resnick et al. ..... 430/264
4,816,373 3/1989 Ohashi et al. ..... 430/264
4,824,764 4/1989 Inagaki et al. ..... 430/264

FOREIGN PATENT DOCUMENTS 0217310 9/1986 European Pat. Off. .
0286062 10/1988 European Pat. Off. ..... 430/598
628202 3/1936 Fed. Rep. of Germany .
56-106244 8/1981 Japan .
62-178246 8/1987 Japan .
62-180361 8/1987 Japan .

OTHER PUBLICATIONS

Morrison and Boyd *Organic Chemistry*, 3rd Ed., 1973, pp. 251 and 254.
"Correlation Analysis in Chemistry" (Chapman and Shorter, eds.), p. 501.
Chapter 4, "Acidity, Hydrogen Bonding and Complex Formation" (A. C. Hopkinson, The Chemistry of the Carbon-Carbon Triple Bond), pp. 76-79.

*Primary Examiner*—Charles L. Bowers, Jr.
*Assistant Examiner*—Janet C. Baxter
*Attorney, Agent, or Firm*—Finnegan, Henderson, Farabow, Garrett and Dunner

[57] ABSTRACT

A silver halide photographic light-sensitive material having a support and provided thereon, at least one silver halide emulsion layer containing Compound [I] or Compound [II] represented by Formula [I] or [II] is disclosed;

Formula [I]

Formula [II]

16 Claims, No Drawings

SILVER HALIDE PHOTOGRAPHIC LIGHT-SENSITIVE MATERIAL CAPABLE OF PROVIDING A HIGH CONTRAST IMAGE

This application is a continuation, of application Ser. No. 07/611,431, filed Nov. 13, 1990, now abandoned, which is a continuation of application Ser. No. 07/312,793, filed Feb. 17, 1989, now abandoned.

FIELD OF THE INVENTION

The present invention relates to a silver halide photographic light-sensitive material, and more specifically to a silver halide photographic light-sensitive material capable of providing a high contrast photographic image.

BACKGROUND OF THE INVENTION

Heretofore, a silver halide photographic light-sensitive material has been used extensively for a photoengraving process. This photoengraving process includes a step of converting an original having a continuous gradation into a halftone image, more specifically, a step of converting the various density levels of continuous gradation of the original into an accumulation of halftone dot patterns each having a dot area proportional to a specific density level on the original.

In this converting step, the original is photographed through a crossline screen or a contact screen with a silver halide photographic light-sensitive material having photographic properties of harder gradation, and the material is subjected to a developing process to form the halftone image.

To provide the photographic image with harder gradation, as disclosed in Japanese Patent Publication Open to Public Inspection No. 106244/1981 and U.S. Pat. No. 4,686,167, a compound such as hydrazine is incorporated as a so-called contrast improver into a silver halide photographic light-sensitive material. And, silver halide particles are used to effectively ensure the harder gradation capability of the above compound, and still other photographic additives are suitably combined to prepare a prescribed photographic light-sensitive material. The silver halide photographic light-sensitive material thus prepared is positively stable as a light-sensitive material and able to provide a high-contrast photographic image even when treated with a developer capable of rapid processing.

Such a silver halide photographic light-sensitive material, however, had a disadvantage that in converting an original having continuous gradation into a halftone image, pepper fogging or a so-called black pinpoint occurred to spoil the quality of the halftone image. To remedy such a disadvantage, various stabilizers or retarders having a hetero atom were used but not always effective.

SUMMARY OF THE INVENTION

The present invention has been accomplished to remedy the above drawback and intended to provide a silver halide photographic light-sensitive material that has good hard gradation and is capable of suppressing fogging occurring on a halftone image and that exhibits high-contrast photographic properties.

DETAILED DESCRIPTION OF THE INVENTION

A silver halide photographic light-sensitive material according to the present invention contains a compound represented by the following formula [I] or [II] (hereinafter referred to as Compound [I] or [II] of the invention):

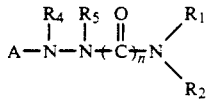

Formula [I]

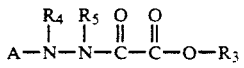

Formula [II]

The above constitution of the invention provides harder gradation and can suppress pepper fog on a halftone image to provide a high-contrast photographic property.

In the formulas, A represents an aryl group or a heterocyclic group containing at least one of a sulfur atom and an oxygen atom, and n represents an integer of 1 or 2. When n represents 1, $R_1$ and $R_2$ represent independently a hydrogen atom, and the groups of alkyl, alkenyl, alkynyl, aryl, heterocyclic, hydroxy, alkoxy, alkenyloxy, alkynyloxy, aryloxy, and heterocyclicoxy, and $R_1$ and $R_2$ may form a ring together with a nitrogen atom. When n represents 2, $R_1$ and $R_2$ represent independently a hydrogen atom, and the groups of alkyl, alkenyl, alkynyl, aryl, saturated and unsaturated heterocyclic, hydroxy, alkoxy, alkenyloxy, alkynyloxy, aryloxy, and heterocyclicoxy, provided that at least one of $R_1$ and $R_2$ represents the groups of alkenyl, alkynyl, saturated heterocyclic, hydroxy, alkoxy, alkenyloxy, alkynyloxy, aryloxy, or heterocyclicoxy. $R_3$ represents alkynyl or saturated heterocyclic groups.

$R_4$ and $R_5$ represent independently a hydrogen atom and the groups of sulfony, acyl and oxalyl.

In more detail, A represents an aryl group (for example, phenyl, naphthyl, etc.) or a heterocyclic group (for example, thiophene, furane, benzothiophene, pyran, etc.) containing at least one of a sulfur atom and an oxygen atom.

$R_1$ and $R_2$ represent independently a hydrogen atom, and the groups of alkyl (for example, methyl, ethyl, methoxyethyl, cyanoethyl, hydroxyethyl, benzyl, and trifluoroethyl), alkenyl (for example, allyl, butenyl, pentenyl, and pentadienyl), alkynyl (for example, propargyl, butynyl, and pentynyl), aryl (for example, phenyl, naphthyl, cyanophenyl, and methoxyphenyl), heterocyclic (for example, unsaturated heterocyclic groups such as pyridine, thiophene and furane, and saturated heterocyclic groups such as tetrahydrofurane and sulfolane), hydroxy, alkoxy (for example, methoxy, ethoxy, benzyloxy, and cyano-methoxy), alkenyloxy (for example, allyloxy and butenyloxy), alkynyloxy (for example, propargyloxy and butylnyloxy), aryloxy (for example, phenoxy and naphthyloxy), and heterocyclicoxy (for example, pyridyloxy and pyrimidyloxy). When n represents 1, $R_1$ and $R_2$ may form a ring (for example, piperidine, pyperazine, and morpholine) together with a nitrogen atom, and when n represents 2, at least one of $R_1$ and $R_2$ represents the groups of alkenyl, alkynyl, saturated heterocyclic, hydroxy, alkoxy, alkenyloxy, alkynyloxy, aryloxy, or heterocyclicoxy.

The examples of the alkynyl group and the saturated heterocyclic group represented by $R_3$ include those described above.

The aryl group or heterocyclic group containing at least one of a sulfur atom and an oxygen atom, each represented by A, may have various substituent groups. The examples of the substituent groups include a halogen atom, and the groups of alkyl, aryl, alkoxy, aryloxy, acyloxy, alkylthio, arylthio, sulfonyl, alkoxycarbonyl, aryloxycarbonyl, carbamoyl, sulfamoyl, acyl, amino, alkylamino, arylamino, acylamino, sulfonamide, arylaminothiocarbonylamino, hydroxy, carboxy, sulfo, nitro, and cyano.

In each formula, A contains preferably at least one of a non-diffusible group and a silver halide adsorptive group. The non-diffusible group preferably includes a ballast group which is commonly used for immobile photographic additives such as a coupler. The ballast group is a group having 8 or more carbon numbers and relatively inactive to photographic properties, and can be selected from the groups of alkyl, alkoxy, phenyl, alkylphenyl, phenoxy, and alkylphenoxy, for example.

The silver halide adsorptive group includes the groups of thiourea, thiourethane, heterocyclic thioamide, mercaptoheterocyclic, and triazole as disclosed in U.S. Pat. No. 4,385,108.

$R_4$ and $R_5$ represent independently a sulfonyl group (for example, methanesulfonyl and toluenesulfonyl), an acyl group (for example, acetyl ethoxy carbonyl, and trifluoroacetyl), and an oxalyl group (for example, pyruvoyl and ethoxyzaryl).

The preferable compounds in the present invention include Compound [I] with n=2 and Compound [II], and more preferably, Compound [I] with n=2, wherein $R_1$ represents a hydrogen atom, an alkyl group, an alkenyl group, an alkynyl group, an aryl group, a saturated or unsaturated hetercyclic group, a hydroxy group, or an alkoxy group; and $R_2$ represents an alkenyl group, an alkynyl group, a saturated heterocyclic group, a hydroxy group, or an alkoxy group.

The typical examples of Compounds [I] and [II] include those shown hereunder. But, it is needless to mention that Compounds [I] and [II] to be used in this invention are not limited to those examples.

Example compounds (1)

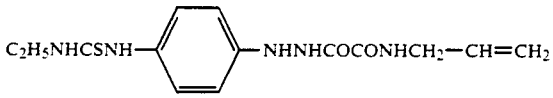

(2)

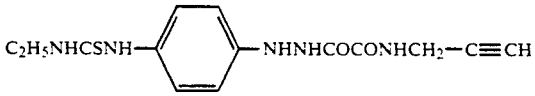

(3)

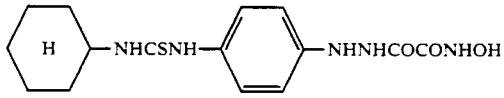

(4)

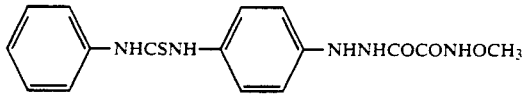

(5)

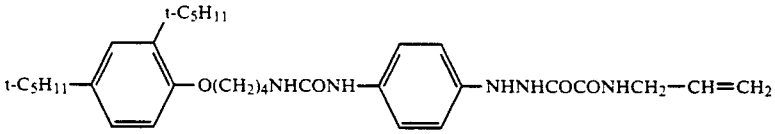

(6)

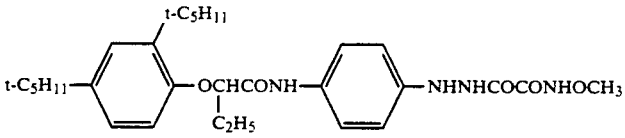

(7)

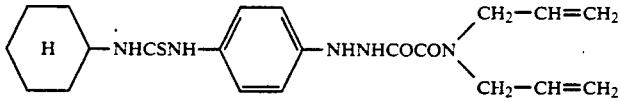

(8)

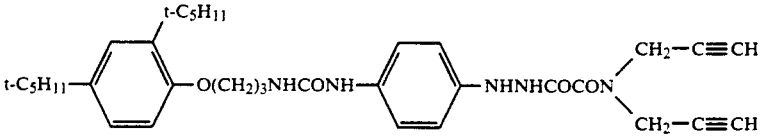

-continued
Example compounds
(9)
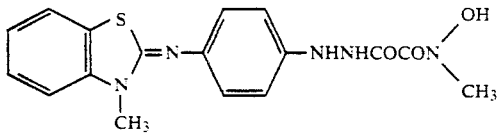
(10)
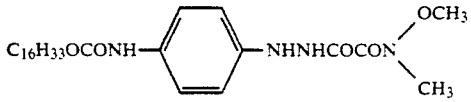
(11)
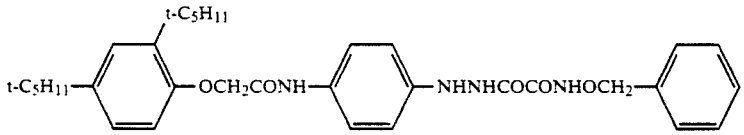
(12)
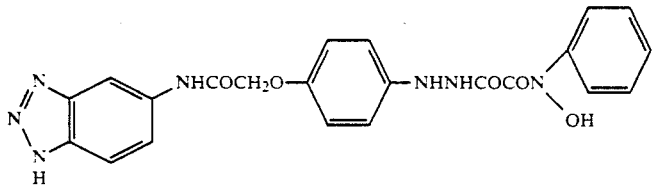
(13)
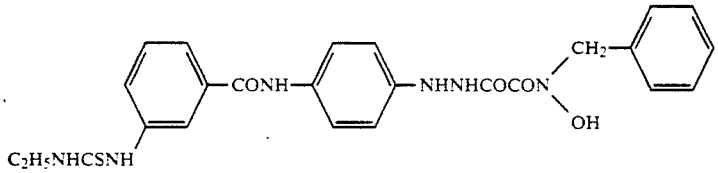
(14)
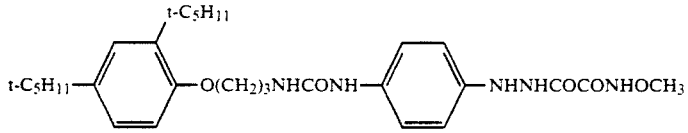
(15)
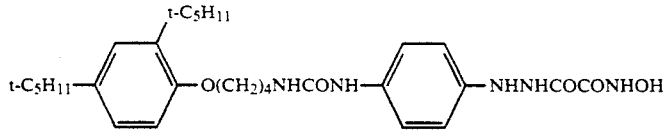
(16)
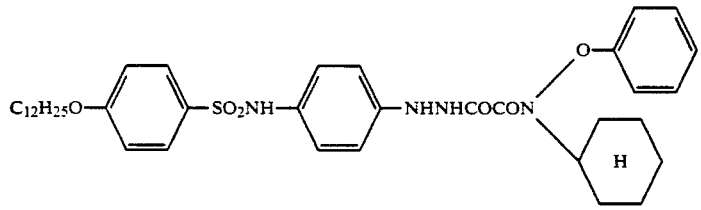
(17)
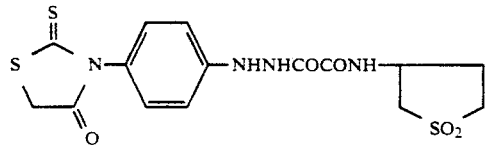

-continued
Example compounds
(18)
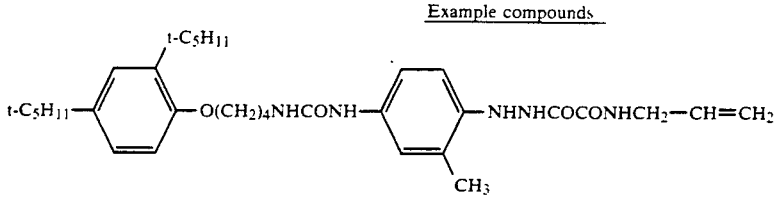
(19)
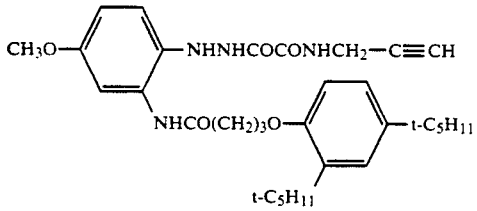
(20)
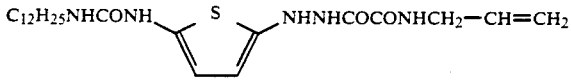
(21)
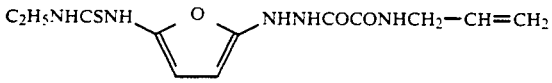
(22)
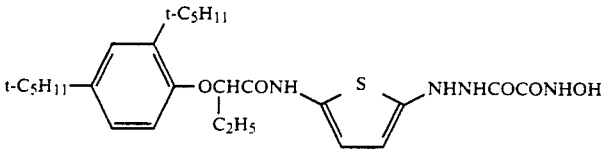
(23)
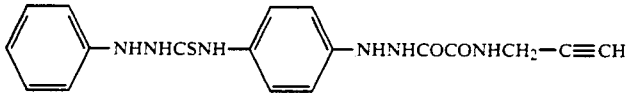
(24)
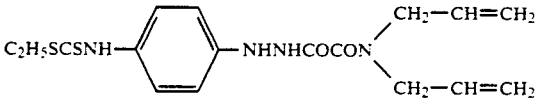
(25)
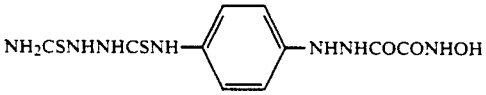
(26)
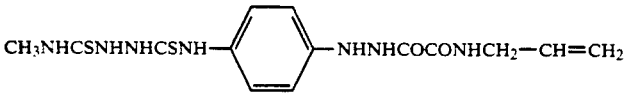
(27)
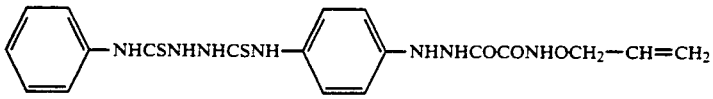
(28)
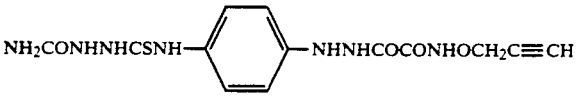
(29)
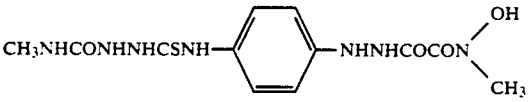

-continued
Example compounds
(30)
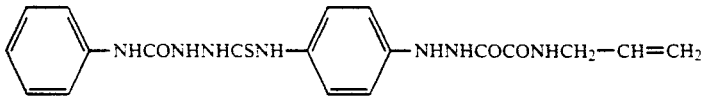
(31)
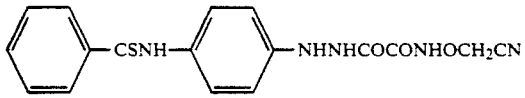
(32)
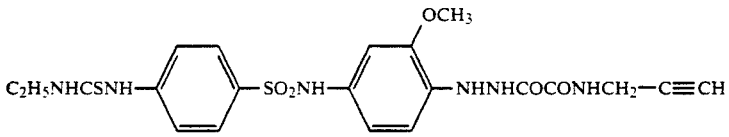
(33)
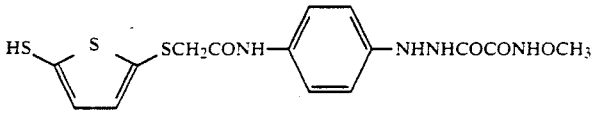
(34)
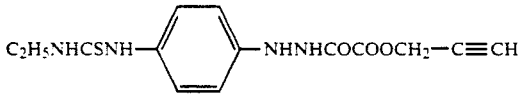
(35)
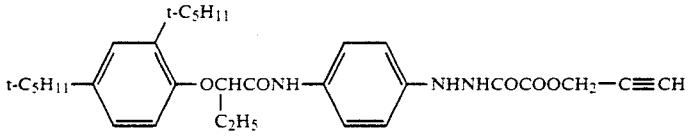
(36)
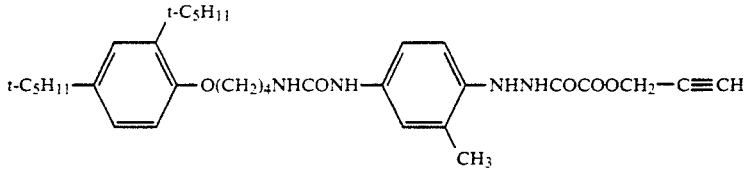
(37)
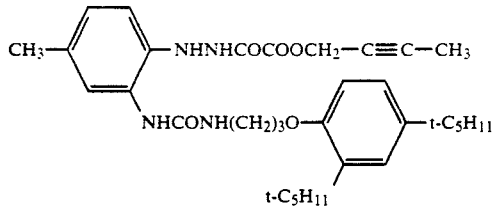
(38)
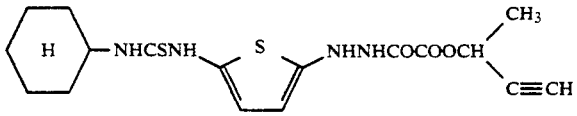
(39)
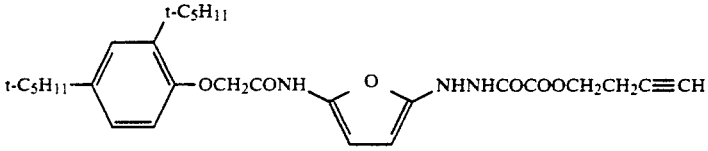

-continued
Example compounds
(40)
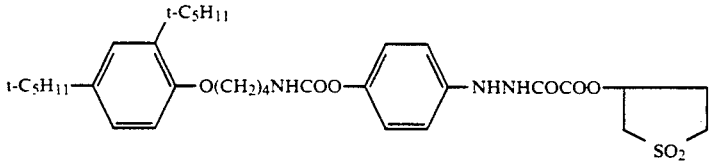
(41)
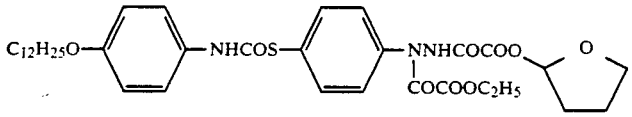
(42)
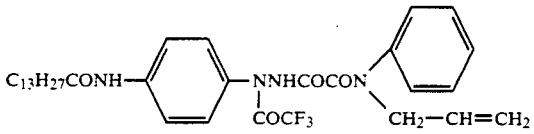
(43)
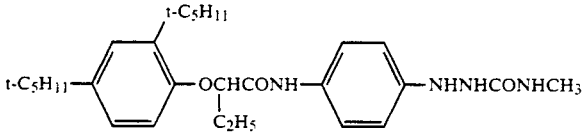
(44)
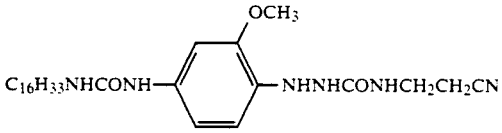
(45)
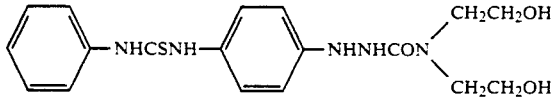
(46)
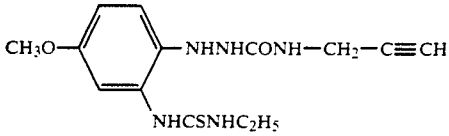
(47)
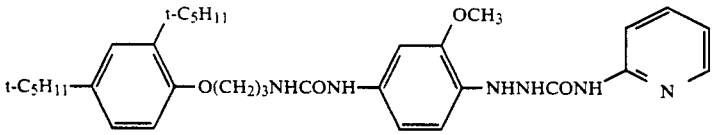
(48)
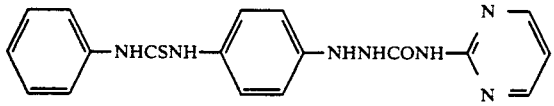
(49)
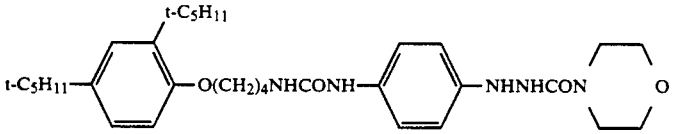
(50)
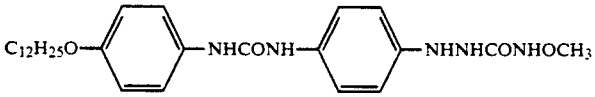

-continued
Example compounds
(51)
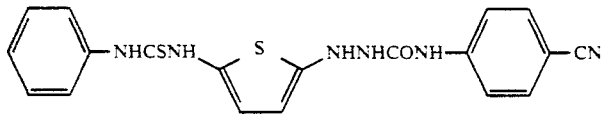
(52)
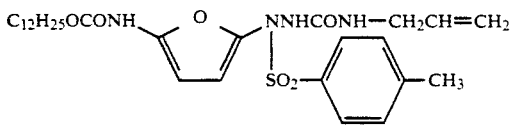
(53)
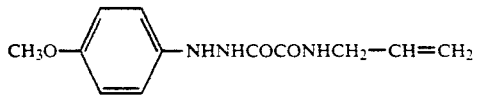
(54)
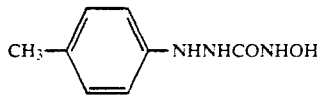
(55)
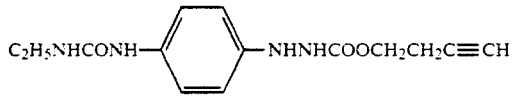
(56)
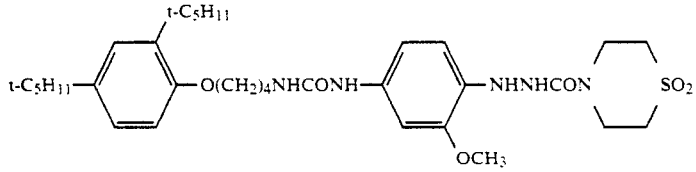
(57)
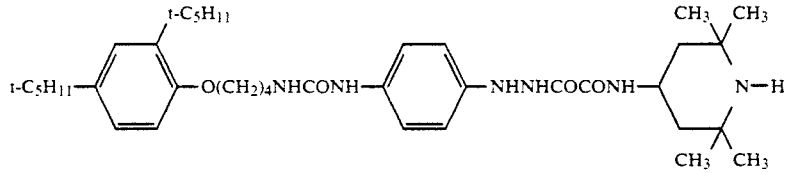
(58)
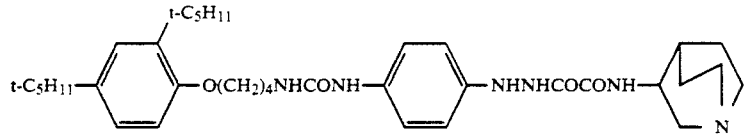
(59)
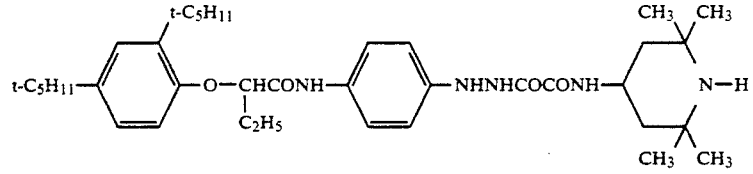
(60)
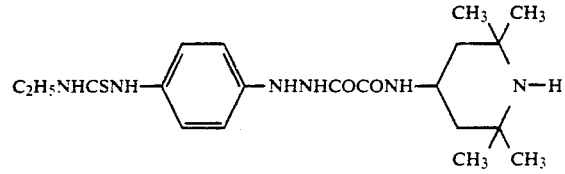

-continued
Example compounds
(61)
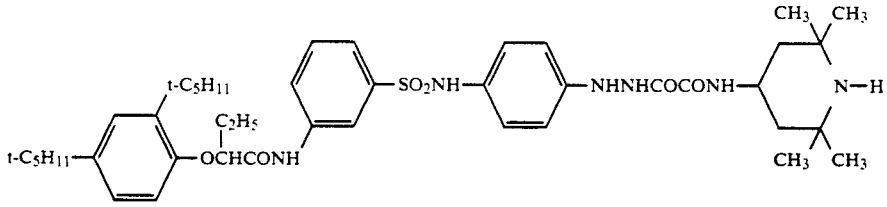
(62)
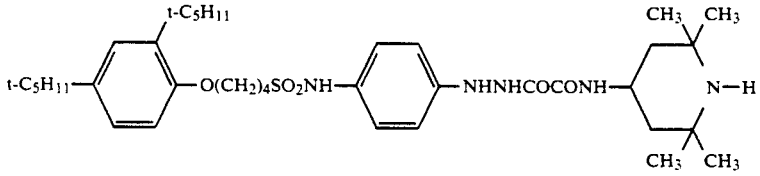
(63)
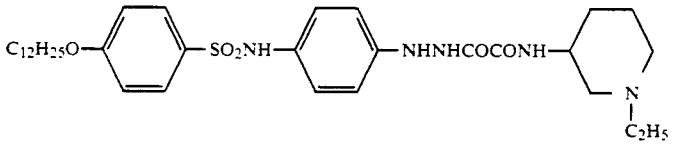
(64)
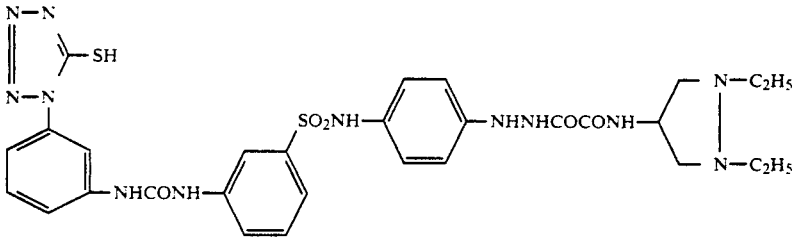
(65)
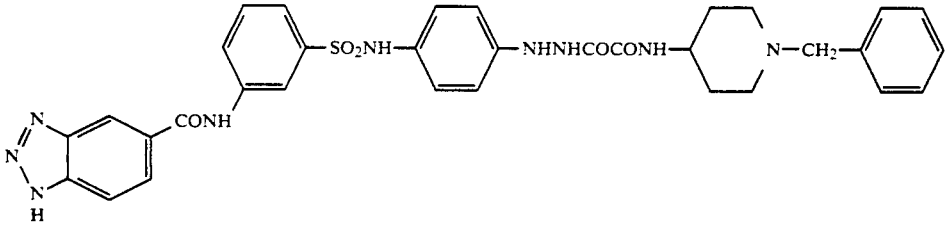
(66)
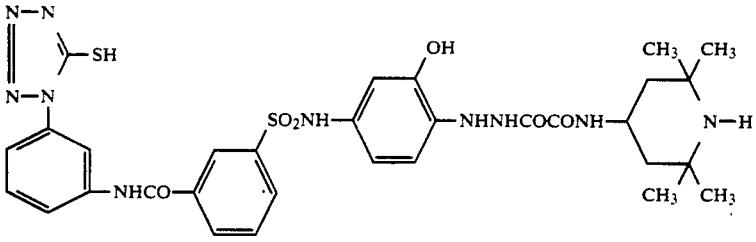
(67)
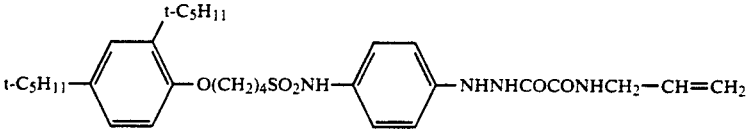

-continued
Example compounds
(68)
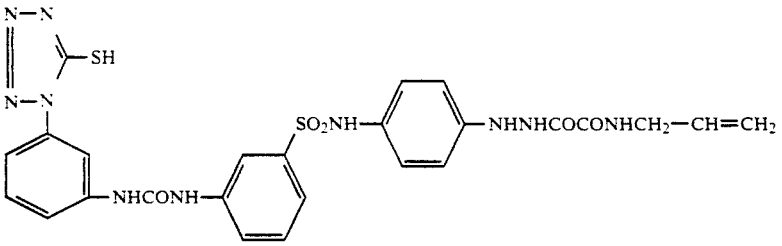
(69)
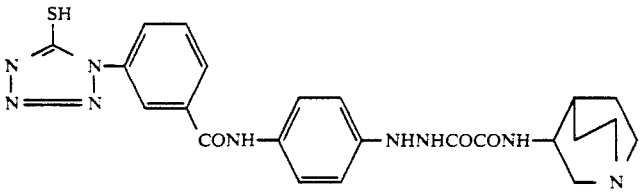
(70)
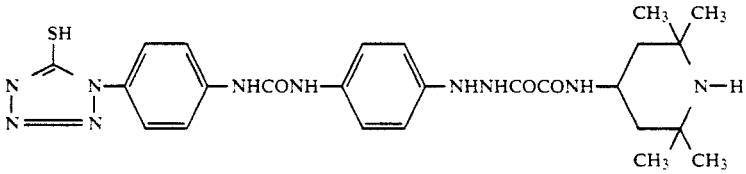
(71)
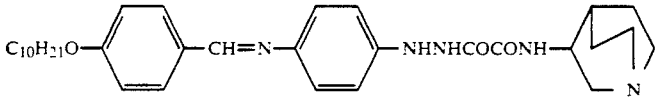
(72)
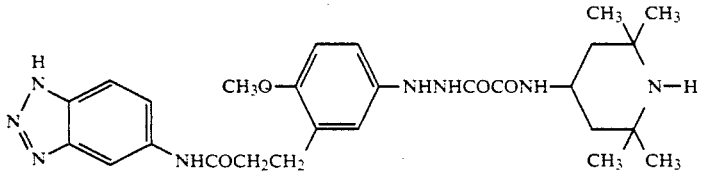
(73)
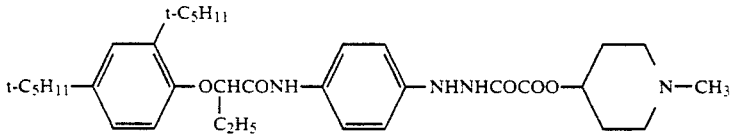
(74)
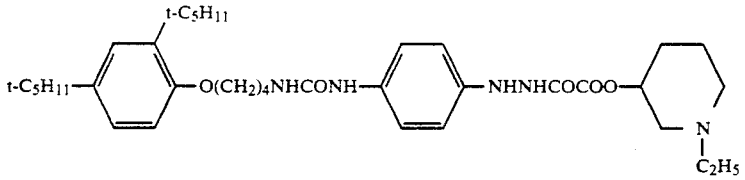
(75)
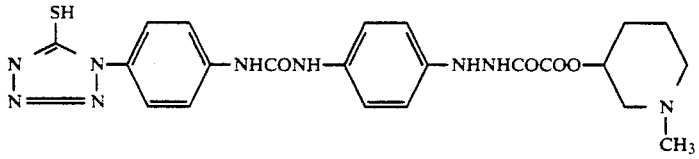
(76)
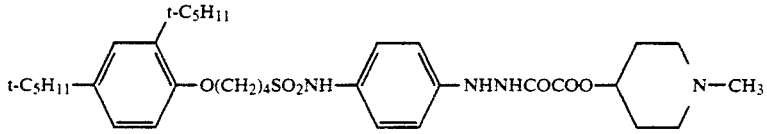

The examples of the methods for synthesizing Compound [I] and [II] of the present invention are described below.

For example, the example compounds (1), (5) and (57) can be synthesized by the following methods.

Synthesis of the compound (1):

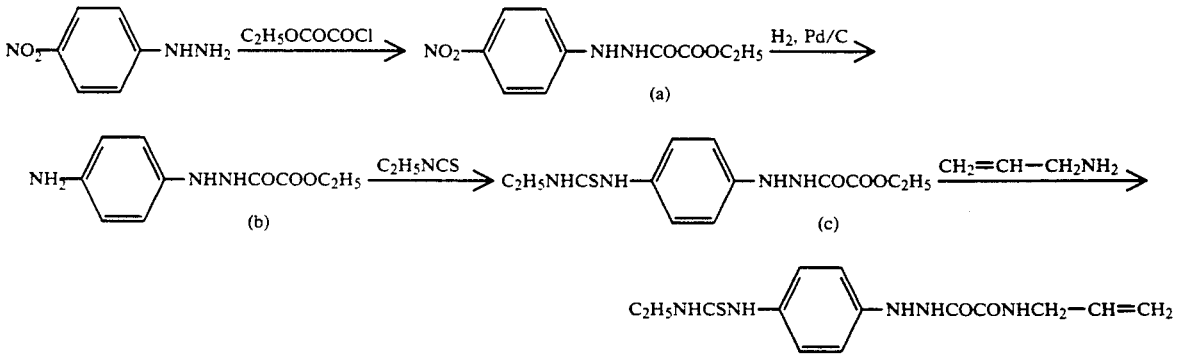

19 g of ethoxyoxalylchloride was added dropwise to 15 g of p-nitrophenyl hydrazine suspended in 150 ml of acetonitrile cooling by ice, and then 14 g of triethylamine was added likewise. The suspension was stirred for one hour at a room temperature. After filtering insoluble matters, a precipitate obtained by concentrating the filtrate was dissolved in 400 ml of chloroform for washing with dilute alkaline water, and then the chloroform solution was concentrated to obtain 29.7 g of a crude product, which was suspended and washed in isopropanol for refining to obtain 16.9 g of a compound (a). 16 g of the compound (a) and 5 g of a Pd/C catalyst added in 160 ml of acetic acid was stirred flowing hydrogen gas at a normal pressure and temperature. After finishing the reaction and filtering off a catalyst residue, the filtrate was concentrated to obtain a crude product. It was refined by means of a chromatography to obtain 5.6 g of a compound (b). 9.5 g of ethylisothiocyanate was added dropwise to 8.1 g of the compound (b) suspended in 89 ml of acetonitrile heating at a refluxing temperature, and the solution was refluxed further for two hours. Then, the solution was concentrated to obtain 11 g of a crude product, which was crystallized for refining to obtain 4.5 g of a compound (c). 40 ml of allylamine where 5.0 g of the compound (c) was dissolved was refluxed for two hours, and then the solution was concentrated to obtain 4.9 g of a crude product, which was suspended and washed in 25 ml of chloroform for refining to obtain 4:3 g of the refined compound (1) having a melting point of 206.9° C. M+1=322 was detected with FAB-MS.

Synthesis of the compound (5):

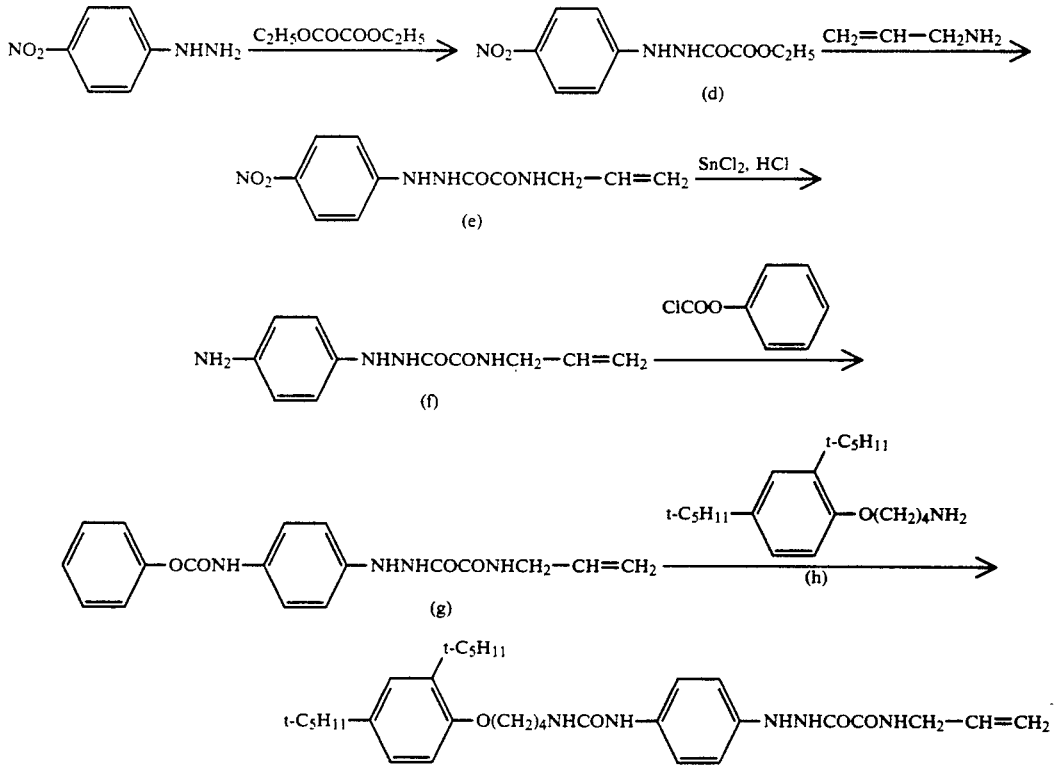

A compound (d) was synthesized according to the method specified in U.S. Pat. No. 4,686,167. 31.3 g of the compound (d) and 10.6 g of allylamine dissolved in 300 ml of ethanol were reacted at a refluxing temperature over a night. After concentrating the solution, 600 ml of benzene was added to the residue to obtain 30 g of a compound (e) by cooling to 5° C. and filtering a precipitate. 150 ml of conc. hydrochloric acid was added to 30 g of the compound (e) dissolved in 540 ml of tetrahydrofuran (THF), and 150.8 g of $SnCL_2$ dissolved in 540 ml of THF was added at a room temperature. After the mixture was reacted at 40° to 50° C. over a night, a precipitated crystal was filtered and suspended in 1 liter of methanol. The methanol solution, which was adjusted to pH 7.5 to 8.0 with $NH_4OH$ and stirred for one hour, was concentrated to a half and cooled to 0° C. to obtain 19.8 g of a compound (f). 11 g of phenyl chloroformate was added dropwise to 15 g of the compound (f) dissolved in 600 ml of pyridine maintaining an inner temperature at lower than 15° C., and the reaction was continued at a room temperature over a night. Then, the pyridine solution was concentrated and a residue was filtered after suspending and washing in 200 ml of acetone to obtain 17 g of a compound (g). 16.8 g of a compound (h) dissolved in 160 ml of pyridine was added to 16.2 g of the compound (g) dissolved in 160 ml of pyridine, and the mixture was reacted at a refluxing temperature for three hours. After finishing the reaction and distilling off pyridine, 300 ml of n-hexane was added to a residue for washing, and a crude crystal was filtered. 180 ml of acetone was added to the crude crystal dissolved in 60 ml of dimethylformamide, and the solution was cooled to 0° C. to obtain 13.8 g of the compound (5). A melting point was 198.5° to 199.5° C. M=565 was detected with FAB-MS.

Synthesis of the compound (57):

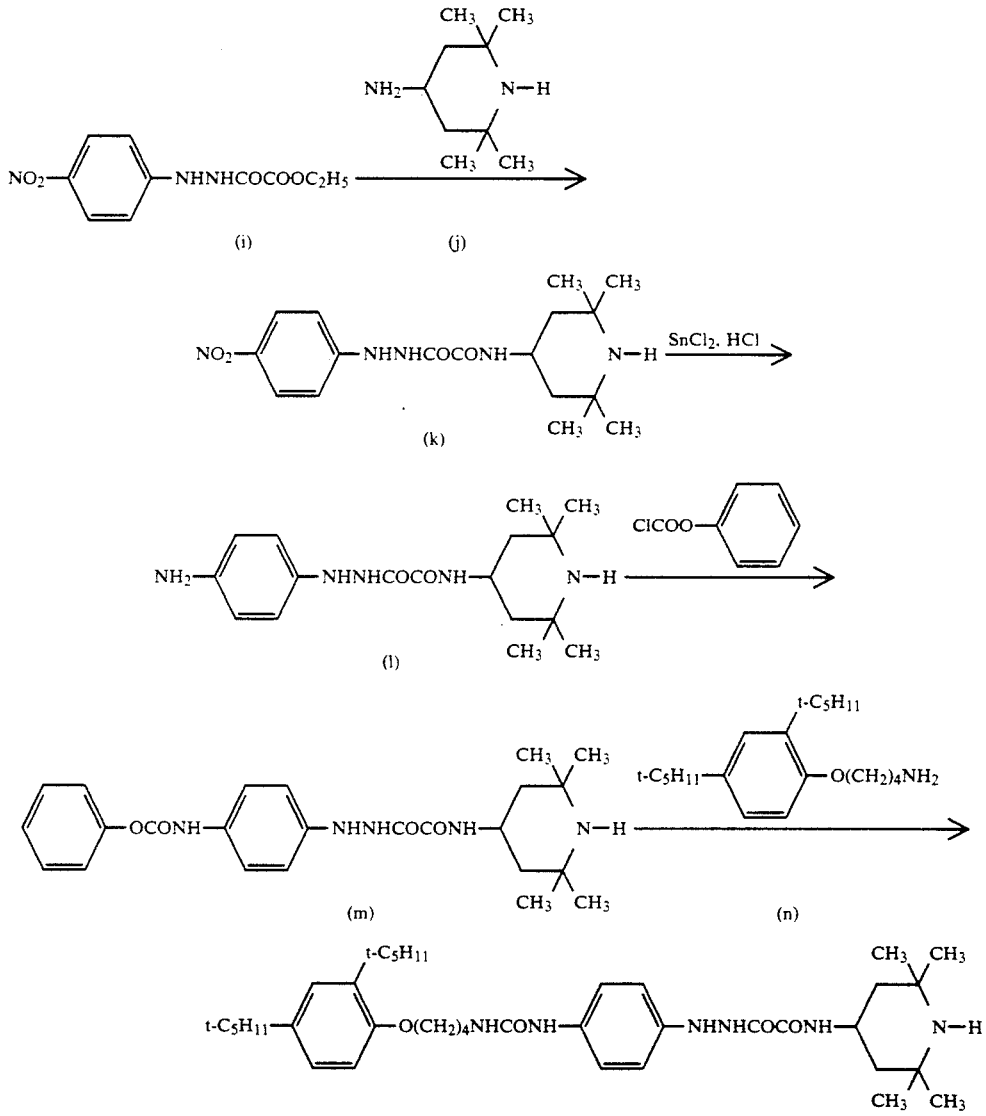

27 g of a compound (i) dissolved in 250 ml of ethanol was reacted with a compound (j) at a refluxing temperature over a night, and then the solution was cooled to 0° C. to obtain a precipitated crystal. The crude crustal was recrystallized with 3 liter of methanol to obtain 20.8 g of a compound (k). 115 ml of conc. HCl was added to 19 g of the compound (k) dissolved in 400 ml of THF, and then 69.4 g of $SnCl_2$ dissolved in 300 ml of THF was added at room temperature. After reacting the mixture at 40° to 50° C. over a night, a precipitated crystal was filtered and dissolved in 420 ml of methanol. Further, 1680 ml of THF was added, and pH of the suspension was adjusted to 8.5 with $NH_4OH$. The suspension was stirred for 15 minutes, and a precipitated crystal was filtered to obtain 11.5 g of a compound (l). 5.2 g of phenyl chloroformate was added dropwise to 10 g of the a compound (l) dissolved in 1 l of pyridine maintaining an inner temperature at lower than 15° C., and then the mixture was reacted at a room temperature over a night. 700 to 800 ml of pyridine was distilled off for concentration, and 400 ml of acetone was added to a residue to obtain a crude crystal. This crude crystal was suspended in 200 ml of acetone for refluxing, and then, 260 ml of DMF was added dropwise to dissolve it and filter off the insoluble substances. The filtered solution was cooled to 0° C. to obtain 8.5 g of a compound (m) by filtering a precipitated crystal. 8.1 g of a compound (n) dissolved in 100 ml of pyridine was added to 10 g of the compound (m) suspended in 200 m( of pyridine and was reacted at a refluxing temperature for three hours. 2 l of acetone was added to the solution to obtain a crystal. This crude crystal was suspended in 85 ml of acetone for refluxing, and just after dropping 85 ml of methanol for dissolving the crystal, the solution was cooled to 0° C. to obtain 6 g of the compound (57) by filtering a precipitated crystal. A melting point was 230° to 231° C. M+1=665 was detected with FAB-MS.

The example compounds (1) and (5) can be synthesized also by the following schematic methods;

Synthesis of the compound (1):

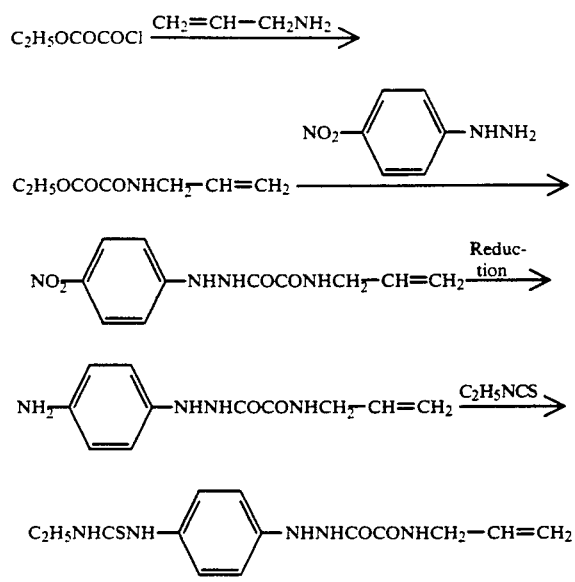

Another synthesis of the compound (1):

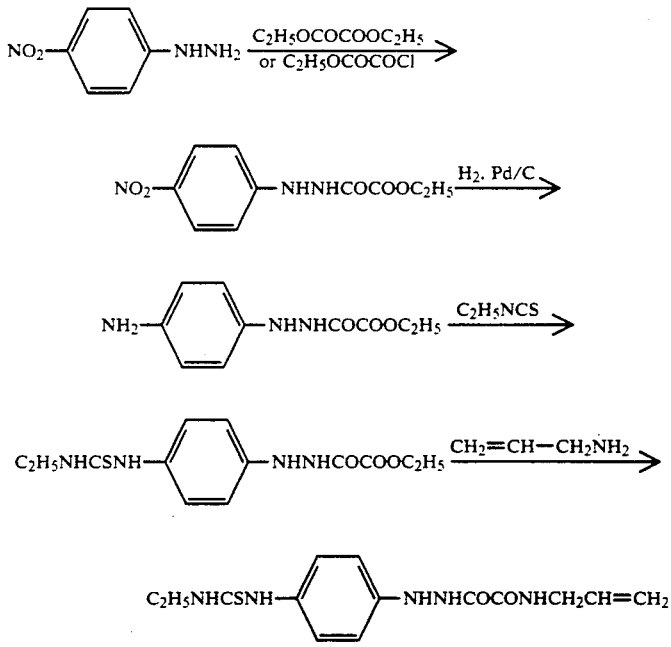

These compounds can be synthesized by referring to the synthesizing methods disclosed in Japanese Patent Publication Open to Public Inspection No. 52050/1980 and U.S. Pat. No. 4,686,167.

Synthesis of the compound (5):

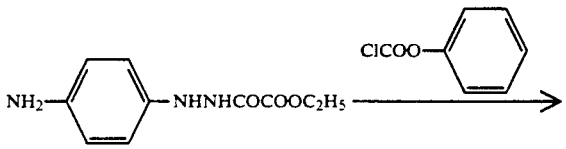

-continued
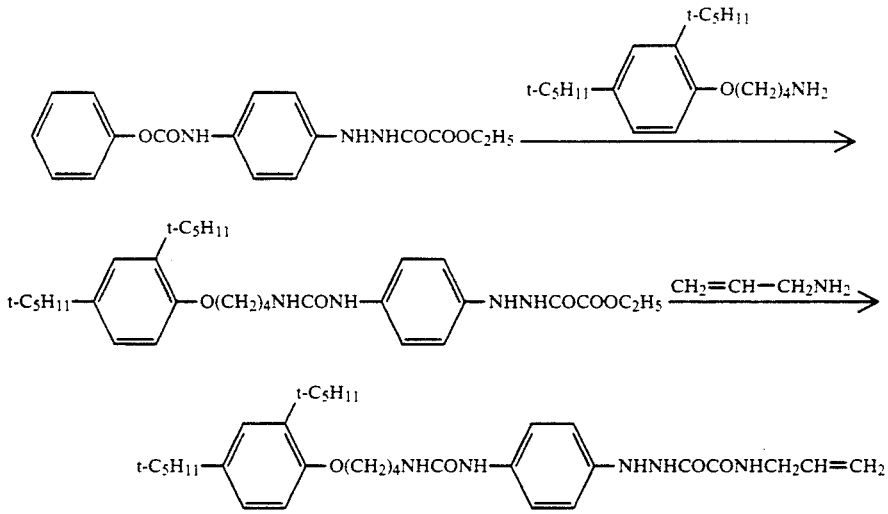
Another synthesis of the compound (5):
-continued
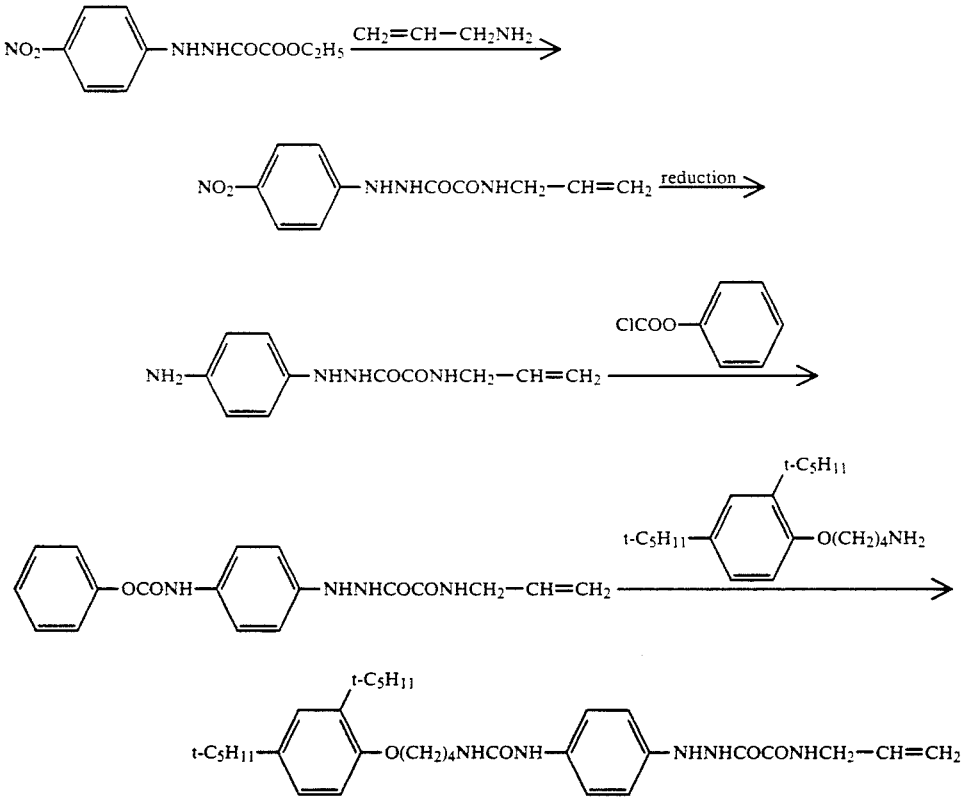
The compounds (3), (35) and (49) can be synthesized by the following schematic methods;
Synthesis of the compound (3):
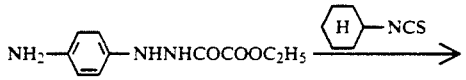
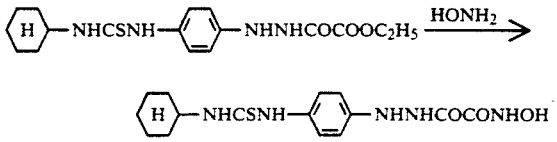
Synthesis of the compound (35):

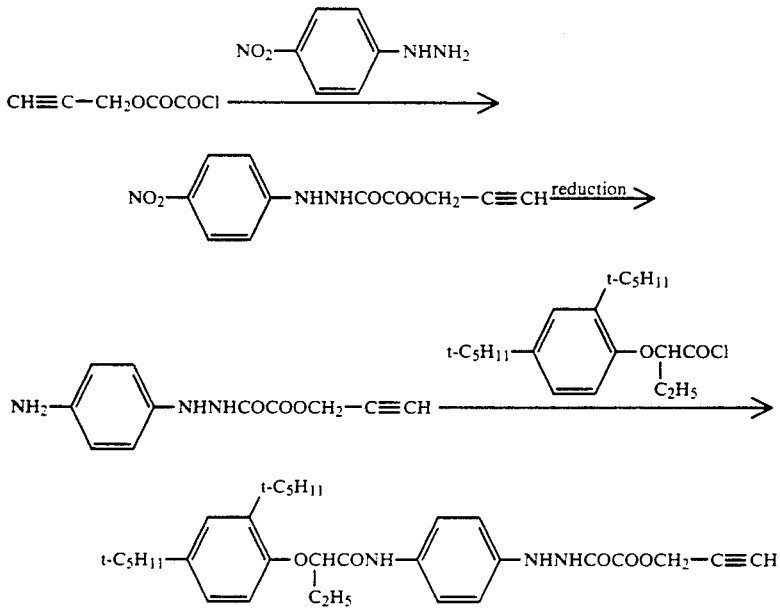

Synthesis of the compound (49):

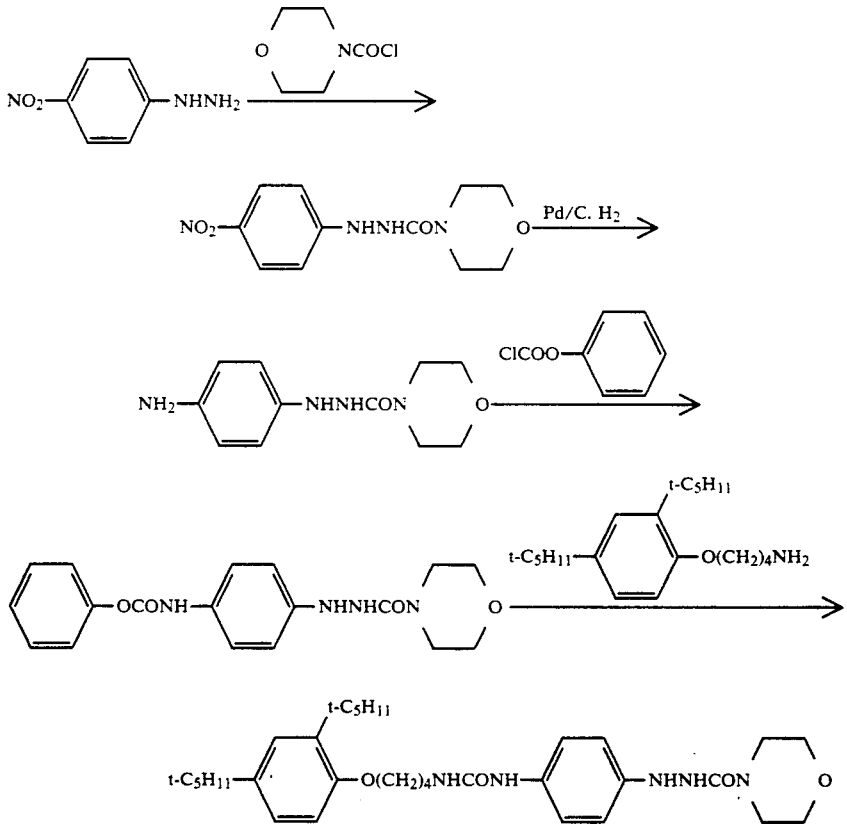

The silver halide photographic light-sensitive material of the present invention contains at least one of Compounds [I] and [II] of the invention. The amount of Compound [I] or [II] contained in the photographic light-sensitive material is preferably $5\times10^{-7}$ to $5\times10^{-1}$ mol per mol silver halide.

The particularly preferable amount ranges from $5\times10^{-5}$ to $1\times10^{-2}$.

The silver halide photographic light-sensitive material of the present invention provides at least one silver halide emulsion layer. More specifically, at least one silver halide emulsion layer may be provided on one side of a support or on both sides of the support. This silver halide emulsion layer can be provided directly on the support or provided via another layer, for example, a hydrophilic colloid layer containing no silver halide emulsion. Further, a hydrophilic colloid layer as a protective layer may be formed on the silver halide emulsion layer. There may be provided the silver halide emulsion layers comprising different sensitivities, for example, high-speed and low-speed sensitivities, wherein an intermediate layer comprising hydrophilic colloid may be placed between the individual silver halide emulsion layers. The intermediate layer may be also interposed between the silver halide emulsion layer and the protective layer. In other words, there may be provided nonsensitive hydrophilic colloid layers such as an intermediate layer, a protective layer, an antihalation layer, a backing layer and the like.

Compound [I] or [II] of the invention in the silver halide photographic light-sensitive material of the invention is preferably incorporated into a hydrophilic colloid layer, and more preferably into a silver halide emulsion layer and/or a hydrophilic colloid layer adjacent to the silver halide emulsion layer.

In the most preferable embodiment of this invention, Compound [I] or [II] is incorporated into the silver halide emulsion layer, and the hydrophilic colloid is gelatin or its derivative.

A method for incorporating Compound [I] or [II] into the hydrophilic colloid layer will be described below. This method includes, for example, a method in which the above compound is dissolved in an appropriate water and/or organic solvent, a method in which a solution prepared by dissolving the above compound in an organic solvent is dispersed in hydrophilic colloid such as gelatin or its derivative, or a method in which the above compound is dispersed in latex. In the present invention, any of the above methods may be used. Compound [I] or [II] can be used independently to provide favorable image properties, but it is conformed that this compound may be used in combination of two or more at an appropriate ratio.

In another method, Compound [I] or [III] is dissolved in water or an appropriate organic solvent such as methanol, ethanol and other alcohols, ethers, and esters, and then the solution is coated directly on the outermost silver halide emulsion layer by an overcoat method to incorporate the compound into the light-sensitive material.

As described above, the present invention includes a preferable embodiment in which Compound [I] or ]II] is incorporated into the silver halide emulsion layer, and another embodiment in which it is incorporated into the hydrophilic colloid layer directly or via the intermediate layer adjacent to the other hydrophilic colloid layers including the silver halide emulsion layer.

The silver halides which are used for the light-sensitive material of the invention will be described below. The silver halides may have any components such as silver chloride, silver bromochloride, silver bromochloride and silver bromide. An average particle size of the silver halide particles is preferably 0.05 to 0.5 μm, and, more preferably 0.10 to 0.40 μm.

The particle size distribution of the silver halide particles used in the invention is arbitrary, but the degree of monodispersion to be defined below is preferably 1 to 30, and more preferably 5 to 20.

The degree of monodispersion is defined by the following equation.

$$\text{Degree of monodispersion} = \sqrt{\frac{\Sigma (r - \bar{r})^2 ni}{\Sigma ni}} \div \bar{r} \times 100$$

The degree of monodispersion is defined as a numeral obtained by multiplying 100 times a value attained by dividing a standard deviation of the particle diameter by an average particle diameter. The particle diameter of the silver halide particles is conveniently indicated by a ridge length of cubic particles.

In the present invention, the silver halide particles can have a multi-layered structure comprising at least two shells. For example, silver bromochloride particles where a core is silver chloride and a shell is silver bromide or the core is silver bromide and the shell is silver chloride, wherein iodine may be contained in any layer, preferably in 5 mol % or less.

In preparing the silver halide emulsion, a rhodium salt may be added to control sensitivity or gradation. Generally, the rhodium salt is added preferably when particles are formed, but may be added in chemical aging or in preparing a coating emulsion. The rhodium salt may be a single salt or double salt, and its typical examples include rhodium chloride, rhodium trichloride, and rhodium ammonium chloride.

An addition amount of the rhodium salt may vary depending on the desired sensitivity and gradation, and the particularly effective range is $10^{-9}$ to $10^{-4}$ mol per mol of silver.

The rhodium salt can be used together with other inorganic compounds such as iridium salt, platinum salt, thallium salt, cobalt salt and gold salt. In particular, the iridium salt is often used to provide a high illuminating property, preferably in the range of $10^{-9}$ mol to $10^{-4}$ mol per mol of silver.

The silver halide can be sensitized with various chemical sensitizers. The examples of the sensitizers include an active gelatin, sulfur sensitizers (sodium thiosulfate, allylthiocarbamide, thiourea, allylisothiocyanate, etc.), selenium sensitizers (N,N-dimethylselenourea, selenourea, etc.), reduction sensitizers (triethylenetetramine, stannous chloride, etc.), and various noble metal sensitizers such as potassium chloroaurite, potassium aurithiocyanate, potassium chloroaurate, 2-aurosulfobenzothiazole methyl chloride, ammonium chloropalladate, potassium chloroplatinate, and sodium chloropalladite. They can be used independently or in combination of two or more. Ammonium thiocyanate can be used as an auxiliary for a gold sensitizer.

In the present invention, silver halide particles of surface latent image type is preferably applied. The surface latent image type particles mean those which provide a higher sensitivity when treated with a surface developer than when treated with an internal developer.

The silver halide emulsion used in this invention can be stabilized or fog can be controlled by using mercaptos (1-phenyl-5-mercaptotetrazole, 2-mercaptobenzothiazole), benzotriazoles (5-bromobenzotriazole, 5-methylbenzotriazole), or benzimidazoles (6-nitrobenzimidazole), and the like. The silver halide emulsions used in this invention may incorporate therein a sensitizing dye, a plasticizer, an antistatic agent, a surface-active agent, and a hardener.

When Compound [I] or [II] of the present invention is added to a hydrophilic colloid layer, gelatin is preferably used as a binder for the hydrophilic colloid layer, but hydrophilic colloid other than gelatin may also be used.

The support used in the invention includes baryta paper, polyethylene-coated paper, polypropylene synthetic paper, glass plate, cellulose acetate, cellulose nitrate and a film of polyester such as polyethylene terephthalate. These supports are suitably selected according to the purposes for which the silver halide photographic light-sensitive material is used.

To develop the silver halide photographic light-sensitive material of the present invention, the following developing agents are available for example.

A typical HO—(CH=CH)$_n$—OH type developing agent includes hydroquinone, and in addition, catechol and pyrogallol.

And a typical HO—(CH=CH)$_n$—NH$_2$ type developer includes ortho- and para-aminophenol or aminopyrazolone, and in addition, N-methyl-p-aminophenol, N-$\beta$-hydroxyethyl-p-aminophenol, p-hydroxyphenylaminoacetic acid, and 2-aminonaphthol.

The examples of a heterocyclic type developing agent include 3-pyrazolidones such as 1-phenyl-3-pyrazolidone, 1-phenyl-4,4-dimethyl-3-pyrazolidone and 1-phenyl-4-methyl-4-hydroxymethyl-3-pyrazolidone.

Besides, the developing agents effectively used in the present invention are disclosed in The Theory of the Photographic Process, Fourth Edition, by T. H. James, pp. 291–334; and Journal of the American Chemical Society, Vol. 73, p. 3,100, (1951). These developing agents may be used independently or in combination of two or more of them, and, preferably in combination of two or more. For a single use, hydroquinone is preferred, and for use in combination, hydroquinone is preferably combined with 1-phenyl-3-pyrazolidone or N-methyl-p-aminophenol.

In a developer used for developing the light-sensitive material of the invention, sulfite such as sodium sulfite and potassium sulfite may be used as a preservative, and such preservatives do not deteriorate the effects of the present invention. A hydroxylamine or hydrazide compound may be also used as the preservative. In addition, it is optional to use caustic alkali, alkali carbonate or amine to adjust a pH value and to provide buffer action. And, it is also optional to add an inorganic developing inhibitor such as potassium bromide; an organic developing inhibitor such as benzotriazole; a metallic ion trapping agent such as ethylenediamine tetraacetic acid; a developing accelerator such as methanol, ethanol, benzyl alcohol, and polyalkylene oxide; a surfactant such as alkyl aryl sodium sulfonate, natural saponin, alkyl esters of sugars or the above compounds; a hardener such as glutaric aldehyde, formalin and glyoxal; and an ion intensity adjuster such as sodium sulfate.

The developer used in the invention may contain alkanolamines or glycols as an organic solvent.

EXAMPLES

The following examples are given to further illustrate the present invention. It is to be understood, however, that the present invention is not limited to these examples.

EXAMPLE 1

The example compounds of Compound [I] or [II] and the comparative compounds as shown in Table 1 were incorporated into the silver halide emulsion layer of the photographic light-sensitive material by the following procedure to prepare samples.

Preparation of silver halide photographic light-sensitive material

On one side of a 100 $\mu$m thick polyethylene terephthalate film having a 0.1 $\mu$m thick subbing layer on each side thereof was coated a silver halide emulsion layer of the following composition (1), and thereon, a protective layer of the following composition (2) was further coated. Onto the subbing layer on the other side of the film was coated a backing layer of the composition (3), and then, a protective layer of the composition (4) was formed thereon to obtain Samples Nos. 1 through 29.

| Composition (1) (Silver halide emulsion layer) | |
|---|---|
| Gelatin | 1.5 g/m$^2$ |
| Silver bromochloride (AgCl 60 mol %. AgBr 40 mol %; degree of monodispersion = 12) | 3.3 g/m$^2$ |
| Antifoggant: 4-hydroxy-6-methyl-1,3,3a,7-tetrazaindene | 0.30 g/m$^2$ |
| Compound of the invention or comparison compound: as in Table 1 | |
| Surface-active agent: Saponin | 0.1 g/m$^2$ |
| Latex polymer: Polyethyl acrylate | 1 g/m$^2$ |
| Sensitizing dye: The following 4 types represented by the formulas (A) through (d) were used together. | |
| (A) Regular sensitizing dye | 5 mg/m$^2$ |

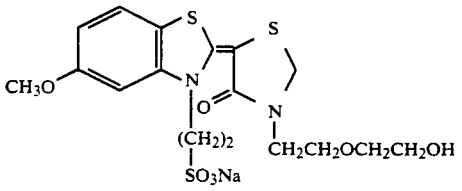

(B) Ortho sensitizing dye 15 mg/m$^2$

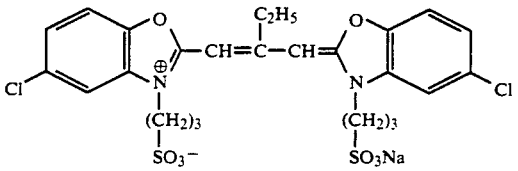

-continued

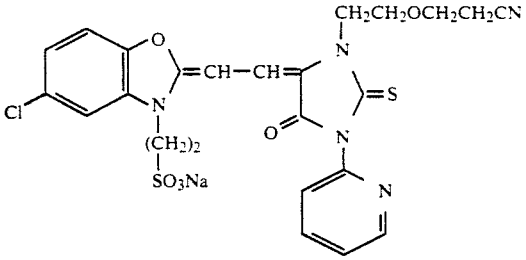

15 mg/m²

(C) Panchromatic sensitizing dye

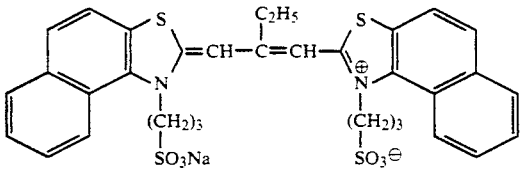

10 mg/m²

(D) Infrared sensitizing dye

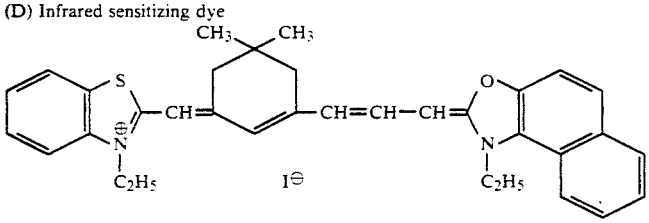

3 mg/m²

Development control agent:

| | |
|---|---|
| Nonylphenoxypolyethylene glycol | 10 mg/m² |
| 5-methylbenzotriazole | 7 mg/m² |
| Adenine | 3 mg/m² |
| Guanine | 2 mg/m² |
| Uracil | 2 mg/m² |
| 1-phenyl-5-mercaptotetrazole | 3 mg/m² |
| Hydroquinone | 100 mg/m² |
| Phenydone | 10 mg/m² |

Composition (2) (Emulsion protective layer)

| | |
|---|---|
| Gelatin | 1.0 g/m² |
| Matting agent: Polymethyl methacrylate with an average particle diameter of 3.0 to 5.0 μm | 0.05 g/m² |
| Surface-active agent: sodium n-dodecylbenzenesulfonate | 0.01 g/m² |
| Electrification modifier: $C_8F_{17}COONH_4$ | 10 mg/m² |
| NaCl | 100 mg/m² |
| LiCl | 30 mg/m² |

Stabilizer: 5 mg/m²

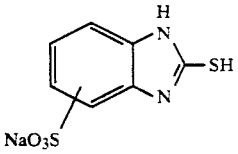

| | |
|---|---|
| 1-phenyl-5-mercaptotetrazole | 3 mg/m² |
| Hardener: Formalin | 0.03 g/m² |

Composition (3) (Backing layer)

| | |
|---|---|
| Gelatin | 3.5 g/m² |

Dye 1 g/m²

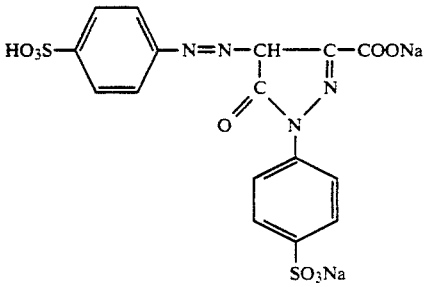

-continued

| | |
|---|---|
| 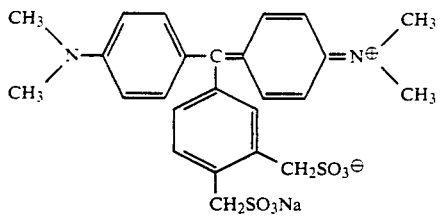 | 1 g/m$^2$ |
| Surface-active agent: saponin | 0.1 g/m$^2$ |
| Hardener: Glyoxal | 0.1 g/m$^2$ |
| Composition (4) (Backing protective layer) | |
| Gelatin | 1 g/m$^2$ |
| Matting agent: Polymethyl methacrylate with an average particle diameter of 3.0 to 5.0 μm | 0.5 g/m$^2$ |
| Surface-active agent: | |
| Sodium p-dodecylbenzenesulfonate | 0.01 g/m$^2$ |
| $C_8F_{17}SO_2NH(CH_2)_3\overset{(CH_3)_2}{\overset{\vert}{\underset{\oplus}{N}}}-CH_2COO^{\ominus}$ | 0.01 g/m$^2$ |
| Development control agent: | |
| 5-nitroindazole | 0.012 g/m$^2$ |
| 5-methylbenzotriazole | 0.02 g/m$^2$ |
| 1-phenyl-5-mercaptotetrazole | 0.005 g/m$^2$ |
| Hardener: Formalin | 0.03 g/m$^2$ |

The samples were subjected to halftone quality test by the following method.

Halftone quality test method

A plate-making halftone screen (150 lines/inch) having a halftone area of 50% was attached to a part of step wedge, and a sample was tightly placed on the screen and was exposed for 5 seconds with a xenon light source. This sample was then developed with an automatic developing machine for rapid processing with the following developer and fixer under the following conditions. The sample was observed for its halftone quality through a 100 power magnifying glass, and the samples were classified into 5 ranks; a rank "5" being assigned to the best one and followed by ranks "4", "3", "2", and "1". Ranks "1" and "2" are levels unacceptable for practical use.

Fogging in halftone dots was also evaluated in the same way and classified depending on the degree of black pinpoint occurred in halftone dots, wherein the best rank "5" was assigned to the samples having no black pinpoint in halftone dots, and was followed by ranks "4", "3", "2", and "1" in descending order depending on the degree of black pinpoint in halftone dots. Ranks "1" and "2" represent large black pinpoints and are deemed to be undesirable for practical use.

| Developing solution ingredients | |
|---|---|
| Composition A | |
| Pure water (ion exchange water) | 150 ml |
| Disodium ethylenediaminetetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide | |
| amount enough to adjust the pH to 10.4 | |
| Potassium bromide | 3 g |
| Composition B | |

-continued

| Developing solution ingredients | |
|---|---|
| Pure water (ion exchange water) | 3 ml |
| Diethylene glycol | 50 g |
| Diethylamino-1,2-propanediol | 15 g |
| Disodium ethylenediaminetetraacetate | 25 mg |
| Acetic acid (90% aqueous solution) | 0.3 ml |
| 5-nitroindazole | 110 mg |
| Sodium 2-mercaptobenzimidazole-5-sulfonate | 30 mg |
| 1-phenyl-3-pyrazolidone | 500 mg |

In using the developing solution, the above compositions were dissolved in 500 ml water in order of A to B, and the total amount was adjusted to 1 liter.

| Fixing solution ingredients | |
|---|---|
| Composition A | |
| Ammonium thiosulfate (72.5% w/v aqueous solution) | 240 ml |
| Sodium sulfite | 17 g |
| Sodium acetate trihydrate | 6.5 g |
| Boric acid | 6 g |
| Sodium citrate dihydrate | 2 g |
| Acetic acid (90% w/w aqueous solution) | 13.6 ml |
| Composition B | |
| Pure water (ion exchange water) | 17 ml |
| Sulfuric acid (50% w/w aqueous solution) | 4.7 g |
| Aluminum sulfate | 26.5 g |
| (Aqueous solution of 8.1% w/w converted to $Al_2O_3$) | |

In using the fixing solution, the above composition were dissolved in 500 ml water in order of A to B, and the total amount was adjusted to 1 liter. This fixing solution had a pH value of about 4.3.

| Developing conditions | | |
|---|---|---|
| Process | Temperature | Time |
| Developing | 38° C. | 30 sec. |
| Fixing | 28° C. | 20 sec. |
| Washing | Normal temp. | 20 sec. |

The comparative compounds added to the silver halide emulsion layer of the composition (1) include the following compounds (a) to (e).

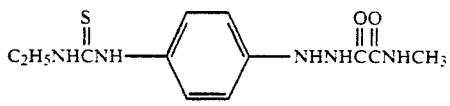

(a)

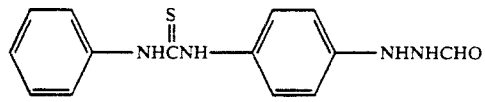

(b)

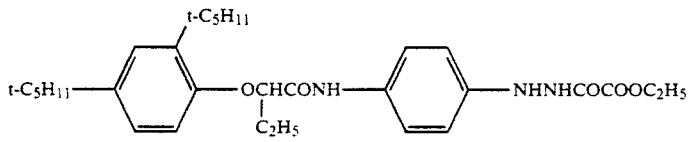

(c)

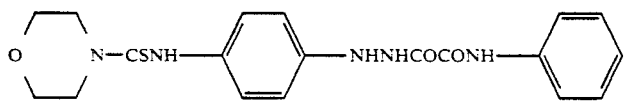

(d)

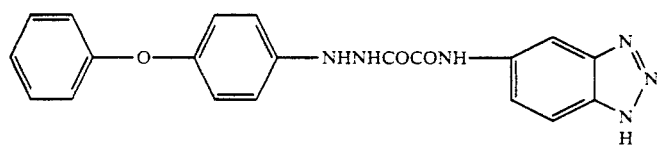

(e)

Test results

Table 1 shows the compounds added to the silver halide emulsion layers and the addition amounts in Samples Nos. 1 through 26 of the present invention and Samples Nos. 27 through 31 containing the above comparative compounds. Compounds [I] or [II] in Table 1 are denoted by the numbers of the example compounds mentioned previously.

Table 2 shows the results of halftone quality test on the above samples in ranks.

It can be found from Table 2 that all Samples Nos. 1 through 26 of the present invention are ranked as "4" or above, while Comparative Samples Nos. 27 through 31 are ranked as "3" in halftone quality. Since ranks "1" and "2" represent an impractical level, Samples Nos. 27 through 31 are by no means good in halftone quality, while Samples Nos. 1 through 26 are very good in halftone quality.

As for occurrence of black pinpoint which is a standard for fogging, Samples Nos. 1 through 26 are ranked as "5" or "4", indicating very good results free from fogging, excepting for Sample No. 15. Comparative Samples Nos. 27 through 31, on the other hand, are ranked as "2" or below, indicating that they cannot be practically used.

TABLE 1

| Sample No. | Compound | Amount added/ mol of Ag | Remarks |
|---|---|---|---|
| 1 | 1 | $5 \times 10^{-4}$ mol | Invention |
| 2 | 2 | $5 \times 10^{-4}$ mol | Invention |
| 3 | 3 | $5 \times 10^{-4}$ mol | Invention |
| 4 | 4 | $5 \times 10^{-4}$ mol | Invention |
| 5 | 5 | $5 \times 10^{-4}$ mol | Invention |
| 6 | 6 | $5 \times 10^{-4}$ mol | Invention |
| 7 | 7 | $5 \times 10^{-4}$ mol | Invention |
| 8 | 8 | $5 \times 10^{-4}$ mol | Invention |
| 9 | 14 | $5 \times 10^{-4}$ mol | Invention |
| 10 | 15 | $5 \times 10^{-4}$ mol | Invention |
| 11 | 22 | $5 \times 10^{-4}$ mol | Invention |
| 12 | 34 | $5 \times 10^{-4}$ mol | Invention |
| 13 | 36 | $5 \times 10^{-4}$ mol | Invention |
| 14 | 39 | $5 \times 10^{-4}$ mol | Invention |
| 15 | 56 | $5 \times 10^{-4}$ mol | Invention |
| 16 | 57 | $5 \times 10^{-4}$ mol | Invention |
| 17 | 58 | $5 \times 10^{-4}$ mol | Invention |
| 18 | 59 | $5 \times 10^{-4}$ mol | Invention |
| 19 | 60 | $5 \times 10^{-4}$ mol | Invention |
| 20 | 62 | $5 \times 10^{-4}$ mol | Invention |
| 21 | 64 | $5 \times 10^{-4}$ mol | Invention |
| 22 | 66 | $5 \times 10^{-4}$ mol | Invention |
| 23 | 67 | $5 \times 10^{-4}$ mol | Invention |
| 24 | 68 | $5 \times 10^{-4}$ mol | Invention |
| 25 | 69 | $5 \times 10^{-4}$ mol | Invention |
| 26 | 70 | $5 \times 10^{-4}$ mol | Invention |
| 27 | a | $5 \times 10^{-4}$ mol | Comparison |
| 28 | b | $5 \times 10^{-4}$ mol | Comparison |
| 29 | c | $5 \times 10^{-4}$ mol | Comparison |
| 30 | d | $5 \times 10^{-4}$ mol | Comparison |
| 31 | e | $5 \times 10^{-4}$ mol | Comparison |

TABLE 2

| Sample No. | Halftone quality | Black pinpoint | Remarks |
|---|---|---|---|
| 1 | 4 | 4 | Invention |
| 2 | 4 | 4 | Invention |
| 3 | 4 | 5 | Invention |
| 4 | 4 | 5 | Invention |
| 5 | 5 | 5 | Invention |
| 6 | 5 | 5 | Invention |
| 7 | 4 | 4 | Invention |
| 8 | 5 | 5 | Invention |
| 9 | 5 | 5 | Invention |
| 10 | 5 | 5 | Invention |
| 11 | 5 | 4 | Invention |
| 12 | 4 | 4 | Invention |
| 13 | 4 | 4 | Invention |
| 14 | 4 | 4 | Invention |
| 15 | 4 | 3 | Invention |
| 16 | 5 | 5 | Invention |

TABLE 2-continued

| Sample No. | Halftone quality | Black pinpoint | Remarks |
|---|---|---|---|
| 17 | 5 | 5 | Invention |
| 18 | 5 | 5 | Invention |
| 19 | 5 | 5 | Invention |
| 20 | 5 | 5 | Invention |
| 21 | 5 | 5 | Invention |
| 22 | 5 | 5 | Invention |
| 23 | 4 | 5 | Invention |
| 24 | 5 | 4 | Invention |
| 25 | 5 | 5 | Invention |
| 26 | 5 | 5 | Invention |
| 27 | 3 | 2 | Comparison |
| 28 | 3 | 2 | Comparison |
| 29 | 3 | 1 | Comparison |
| 30 | 3 | 2 | Comparison |
| 31 | 3 | 2 | Comparison |

EXAMPLE 2

Based on Samples Nos. 5, 10, 16 and 25 in Example 1 Samples Nos. 32 through 51 were prepared, wherein the degrees of monodispersion (uniformity of particle size) of the silver halide particles were changed to 4 to 40.

In preparing the particles, rhodium and iridium were incorporated by a conventional procedure in amounts of $8\times10^{-7}$ mol/mol of Ag and $3\times10^{-7}$ mol/mol of Ag, respectively. Silver halide used was silver bromochloride having 98 mol % of silver chloride, and instead of sensitizing dyes (A), (B), (C), and (D), the desensitizing dye having the following structure was added.

Desensitizing dye (the sum of anode and cathode electric potentials in polarograph being positive)

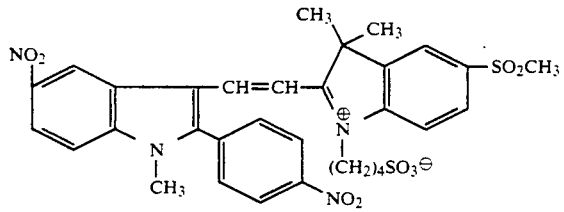

Furthermore, 50 mg/m$^2$ of the following filter dye was added to the protective layer, and the following ultraviolet absorbing dye was also added in 100 mg/m$^2$.

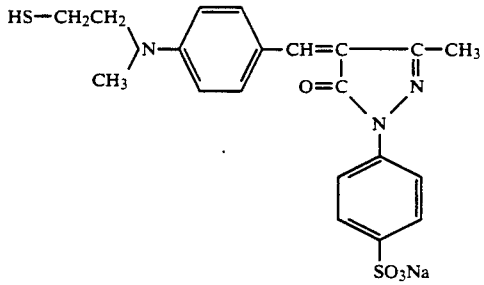

Maximum absorption wavelength ($H_2O$) max: 492 nm

-continued

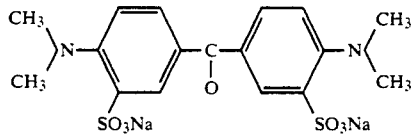

The other procedures were the same as those of Samples Nos. 5, 10, 16 and 25. For example, as Compound I] or [II], the same example compounds Nos. 5, 15, 57 and were used. The degree of monodispersion can be controlled by a conventional control double jet method, by varying a pH potential, supplied amounts of Ag ion and halide ion when the particles are prepared. Exposure and developing process were also performed by the same procedure as Example 1, and photographic performance was evaluated likewise. In this example, the samples were exposed to an extra-high voltage mercury lamp with energy of 5 mJ.

The evaluation results are shown in Table 3. It can be found that Samples Nos. 32 through 51 are favorably ranked as 4.5 to 5 in halftone quality and 4.5 to 5 in black pinpoint, indicating a high halftone quality and very little fogging.

TABLE 3

| Sample No. | Compound | Degree of monodispersion of silver halide particles | Photographic performance | |
|---|---|---|---|---|
| | | | Halftone quality | Black pinpoint |
| 32 | 5 | 50 | 4.5 | 4.5 |
| 33 | 5 | 35 | 4.7 | 4.6 |
| 34 | 5 | 20 | 4.8 | 4.7 |
| 35 | 5 | 10 | 5 | 5 |
| 36 | 5 | 4 | 5 | 5 |
| 37 | 15 | 40 | 4.5 | 4.5 |
| 38 | 15 | 35 | 4.6 | 4.6 |
| 39 | 15 | 20 | 4.8 | 4.8 |
| 40 | 15 | 10 | 5 | 5 |
| 41 | 15 | 4 | 5 | 5 |
| 42 | 57 | 40 | 4.6 | 4.5 |
| 43 | 57 | 35 | 4.8 | 4.6 |
| 44 | 57 | 20 | 4.9 | 4.7 |
| 45 | 57 | 10 | 5 | 5 |
| 46 | 57 | 4 | 5 | 5 |
| 47 | 69 | 40 | 4.6 | 4.6 |
| 48 | 69 | 35 | 4.7 | 4.8 |
| 49 | 69 | 20 | 4.9 | 4.9 |
| 50 | 69 | 10 | 5 | 5 |
| 51 | 69 | 4 | 5 | 5 |

The present invention can provide a light-sensitive material having a good hard gradation and excellent halftone image quality by incorporating Compound [I] or [II] of the present invention into a silver halide photographic light-sensitive material.

What is claimed is:

1. A silver halide photographic light-sensitive material having a support and provided thereon, hydrophilic colloid layers including at least one silver halide emulsion layer containing silver halide particles and additives, wherein said silver halide photographic light-sensitive material comprises at least one of Compound [I] and Compound [II] represented by Formulas [I] and [II], respectively;

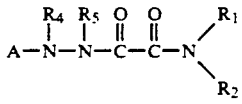

Formula [I]

-continued

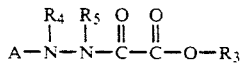

Formula [II]

wherein at least one of said Compound [I] and Compound [II] is incorporated into said hydrophilic colloid layers and wherein A represents one selected from a group consisting of an aryl group and a heterocyclic group containing at least one of a sulfur atom and an oxygen atom; $R_1$ and $R_2$ represent independently a hydrogen atom, an alkyl group, an alkenyl group, an alkynyl group, an aryl group, a saturated heterocyclic group or an unsaturated heterocyclic group, provided that at least one of $R_1$ and $R_2$ represents an alkenyl group, an alkynyl group, or a saturated heterocyclic group; $R_3$ represents one selected from a group consisting of an alkynyl group and a saturated heterocyclic group; $R_4$ and $R_5$ represents independently a hydrogen atom, a suifonyl group, an acyl group or an oxalyl group.

2. The photographic material of claim 1, wherein A comprises at least one of a non-diffusible group and a silver halide adsorptive group.

3. The photographic material of claim 2, wherein said non-diffusible group is a ballast group having not less than eight carbon atoms.

4. The photographic material of claim 3, wherein said ballast group is an alkyl group, an alkoxy group, a phenyl group, an alkylphenyl group, a phenoxy group or an alkylphenoxy group.

5. The photographic material of claim 2, wherein said silver halide adsorptive group is a thiourea group, a thiourethane group, a thioamide heterocyclic group, a mercapto heterocyclic group, or a triazole group.

6. The photographic material of claim 1 wherein at least one of said Compound [I] and [II] is incorporated into at least one of the silver halide emulsion layer and the hydrophilic colloid layer adjacent directly or via the intermediate layer to said silver halide emulsion layer.

7. The photographic material of claim 6, wherein at least one of the silver halide emulsion layer and the hydrophilic colloid layer adjacent to said silver halide emulsion layer comprises said Compound [I].

8. The photographic material of claim 7, wherein $R_1$ represents a hydrogen atom, an alkyl group, an alkenyl group, an alkynyl group, an aryl group, a saturated or unsaturated heterocyclic group, a hydroxy group, or an alkoxy group; and $R_2$ represents an alkenyl group, an alkynyl group, a saturated heterocyclic group, a hydroxy group, or an alkoxy group.

9. The material of claim 1, wherein an average particle size of the silver halide particles is 0.05 to 0.5 μm.

10. The material of claim 9, wherein a monodispersion degree defined by Equation [I] is 5 to 20;

$$\sqrt{\frac{\Sigma(\bar{r}-ri)^2 ni}{\Sigma ni}} \div \bar{r} \times 100 \qquad \text{Equation [I]}$$

wherein $\bar{r}$ represents an average particle size of the halide particles; ri represents a particle size of the respective particles; and ni represents number of the particles.

11. The material of claim 1, wherein at least one of the additives contained in the silver halide emulsion layer is a rhodium sat.

12. The material of claim 11, wherein said rhodium salt is used in combination with an iridium salt.

13. The material of claim 12, wherein an addition amount of the rhodium salt and the iridium salt is each $1\times10^{-9}$ mol to $1\times10^{-4}$ mol per mol of silver.

14. The material of claim 9, wherein an addition amount of said Compound [I] or [II] is $5\times10^{-7}$ mol to $5\times10^{-1}$ mol per mol of silver halide.

15. The material of claim 14, wherein the addition amount is $5\times10^{-5}$ mol to $1\times10^{-2}$ mol per mol of silver halide.

16. A silver halide photographic light-sensitive material having a support and provided thereon hydrophilic colloid layers including at least one silver halide emulsion layer containing silver halide particles and additives, wherein said silver halide photographic light-sensitive material comprises at least one compound represented by Formula I:

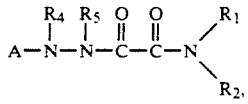

(I)

wherein A is selected from the group consisting of an aryl group and a heterocyclic group containing at least one of a sulfur atom and an oxygen atom; $R_1$ and $R_2$ each independently is selected from the group consisting of a hydrogen atom, an alkyl group, an alkenyl group, an alkynyl group, an aryl group, a saturated heterocyclic group and an unsaturated heterocyclic group, provided that at least one of $R_1$ and $R_2$ represents an alkenyl group, an alkynyl group, or a saturated heterocyclic group; and $R_4$ and $R_5$ each is independently selected from the group consisting of a hydrogen atom, a sulfonyl group, an acyl group and an oxalyl group.

* * * * *

UNITED STATES PATENT AND TRADEMARK OFFICE

CERTIFICATE OF CORRECTION

PATENT NO. : 5,158,856

DATED : October 27, 1992

INVENTOR(S) : Yasushi Usagawa et al.

It is certified that error appears in the above-identified patent and that said Letters Patent is hereby corrected as shown below:

Claim 1, Column 41, Line 19, change "represents" to --represent--;

Claim 10, Column 42, Line 11, before "halide" insert --silver--;

Claim 11, Column 42, Line 16, change "sat" to --salt--;

Claim 14, Column 42, Line 22, change "claim 9" to --claim 6--.

Signed and Sealed this

Fourteenth Day of December, 1993

*Attest:*

*Attesting Officer*

BRUCE LEHMAN

*Commissioner of Patents and Trademarks*